US008491831B2

(12) United States Patent
Buedel et al.

(10) Patent No.: US 8,491,831 B2
(45) Date of Patent: Jul. 23, 2013

(54) METHODS FOR FORMING CONCRETE WALL STRUCTURES

(75) Inventors: Daniel Buedel, Durham, NC (US); Justin Leitzel, Durham, NC (US)

(73) Assignee: Ideal Precast, Inc., Durham, NC (US)

( * ) Notice: Subject to any disclaimer, the term of this patent is extended or adjusted under 35 U.S.C. 154(b) by 443 days.

(21) Appl. No.: 12/793,716

(22) Filed: Jun. 4, 2010

(65) Prior Publication Data

US 2010/0307083 A1 Dec. 9, 2010

Related U.S. Application Data

(60) Provisional application No. 61/184,128, filed on Jun. 4, 2009.

(51) Int. Cl.
*B28B 23/00* (2006.01)
*E04B 2/84* (2006.01)

(52) U.S. Cl.
USPC ..... 264/333

(58) Field of Classification Search
USPC ..... 264/333
See application file for complete search history.

(56) References Cited

U.S. PATENT DOCUMENTS 3,488,817 A * 1/1970 Katz ..... 425/441
4,090,336 A * 5/1978 Carroll ..... 52/309.7
5,956,911 A * 9/1999 Kistner et al. ..... 52/302.3
6,427,406 B1 * 8/2002 Weaver et al. ..... 52/414
6,494,004 B1 * 12/2002 Zimmerman ..... 52/251

* cited by examiner

*Primary Examiner* — Christina Johnson
*Assistant Examiner* — Patrick Butler
(74) *Attorney, Agent, or Firm* — Olive Law Group, PLLC

(57) ABSTRACT

A method for forming a concrete wall structure is provided. The method includes providing a frame having a plurality of spaced-apart wall studs interconnecting opposing frame members within a casting bed. A plurality of blocks are positioned proximal the frame within the interior area of the casting bed. Concrete is poured and finished within the casting bed.

10 Claims, 6 Drawing Sheets

METHODS FOR FORMING CONCRETE WALL STRUCTURES

PRIORITY CLAIM

This application claims priority to U.S. Provisional Patent Application No. 61/184,128 filed on Jun. 4, 2009, the contents of which are hereby incorporated by reference.

TECHNICAL FIELD

The subject matter described herein relates to prefabricated concrete wall structures. In particular, the subject matter described herein relates to assembly systems and methods for forming concrete wall structures.

BACKGROUND

Concrete walls are presently being prefabricated as a way to avoid the time consuming and labor intensive process of building walls with cinder blocks or pouring concrete at a construction site. By use of prefabricated concrete walls, the construction of a wall at the construction site is no longer linked to the amount of manpower available because the labor involves only installation of the previously manufactured wall. Additionally, the cost of the wall is relatively unrelated to the size of the wall.

Generally, the manufacture of a prefabricated concrete wall involves use of a casting bed that includes a set of channel members oriented in a horizontal plane. The channels are arranged in parallel, and the channels include precut notches on their innermost walls. These notches are used to support previously manufactured concrete studs which are set in the horizontal plane perpendicular to the parallel channels. A typical spacing for the notches is two feet center to center.

The channel members and frame sides joining the ends of the channel members are constructed so that the peripheral edges of the grid formed by the studs and the channels, that is, the edges forming an outside rectangle, are higher than all the other members by approximately four inches to form a frame around the entire structure. The parallel channel members which form the support for the concrete studs include cavities of considerable volume which are eventually filled with concrete to encase the ends of the concrete studs which are set into the notches in the channels with the ends of the studs extending into the cavities.

Before concrete is poured into the casting bed, sheet insulation is laid over the concrete studs and impaled upon fasteners cast into and protruding from the concrete studs, and wire reinforcing mesh is laid atop the sheet insulation, but the sheet insulation is sized so that it does not cover the cavities of the channel members.

The wall is then completed by pouring concrete into the casting bed so that it covers the insulation, the wire mesh, and fasteners protruding through the insulation, and fills the cavities in the channel members. The concrete is poured to the height of the top of the outer frame members, and once hardened, not only forms an integral exterior surface, but also bonds together the studs, the insulation, and the top and bottom support beams which are formed in the channel members. The final step of manufacture includes lifting the hardened concrete wall from the casting bed.

This method of making a concrete wall structure is undesirable though due to the length of time required for construction and low insulating values. While sheet insulation is laid over the concrete studs, this relatively thin layer of insulation does not offer adequate insulation properties. Additionally, the wire mesh does increased structural strength of the concrete wall, however, a rebar support member or the like would add even greater structural strength. Accordingly, it is desirable to provide an improved method for making a concrete wall that is quicker to manufacture and has increased insulation properties and increased structural integrity.

SUMMARY

It is an object of the presently disclosed subject matter to provide novel assembly systems and methods for forming concrete wall structures.

An object of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

The subject matter described herein will now be explained with reference to the accompanying drawings of which.

DETAILED DESCRIPTION

Assembly methods for forming concrete wall structures are disclosed herein. An assembly method according to an embodiment of the subject matter disclosed herein can include a casting bed having a plurality of surfaces for defining an interior area. A concrete wall structure can be formed in the interior area of the casting bed. The surfaces can be moved to predetermined positions with respect to one another such that the concrete wall structure is formed with one or more of a predetermined width, a predetermined height, and a predetermined depth.

Figure 1:
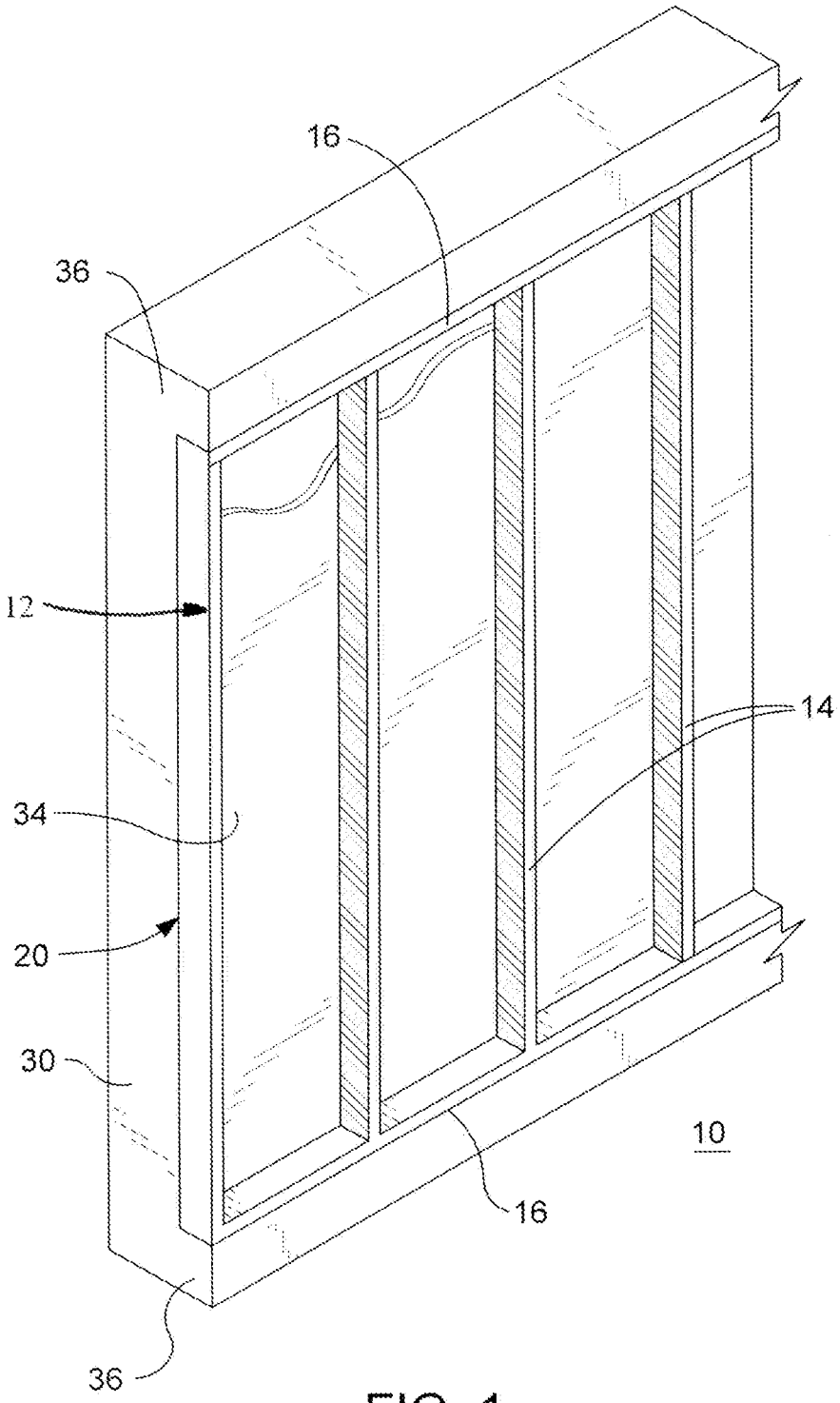
FIG. 1 is a perspective view of a concrete wall structure in accordance with an embodiment of the disclosed subject matter.

FIG. 1 illustrates a perspective view of an exemplary concrete wall structure, generally designated 10, in accordance with an embodiment of the subject matter disclosed herein. The concrete wall structure 10 may include a frame 12 (as illustrated in greater detail in FIGS. 2 through 5) that has a plurality of spaced-apart wall studs 14 interconnecting opposing frame members 16. The wall studs 14 are spaced-apart according to engineering design, and may be spaced-apart at twelve (12), eighteen (18), or twenty-four inches (24)

off-center, or any other desired spacing. The wall studs 14 and frame members 16 may be attached via fasteners such as screws, bolts, or the like, or may be attached via welding or any other suitable manner. The wall studs 14 may be formed from square beams, I-beams, or any other desired shape.

An insulating layer 20 may be carried by the frame 12, and in an embodiment, may be a sheet of insulating material 34, i.e. a support panel, such as extruded and/or expanded polystyrene. A concrete layer 30 is carried by the insulating layer 20 and extends towards an upper and lower portion of the frame 12 to form header and footer sections 36.

Figure 2:
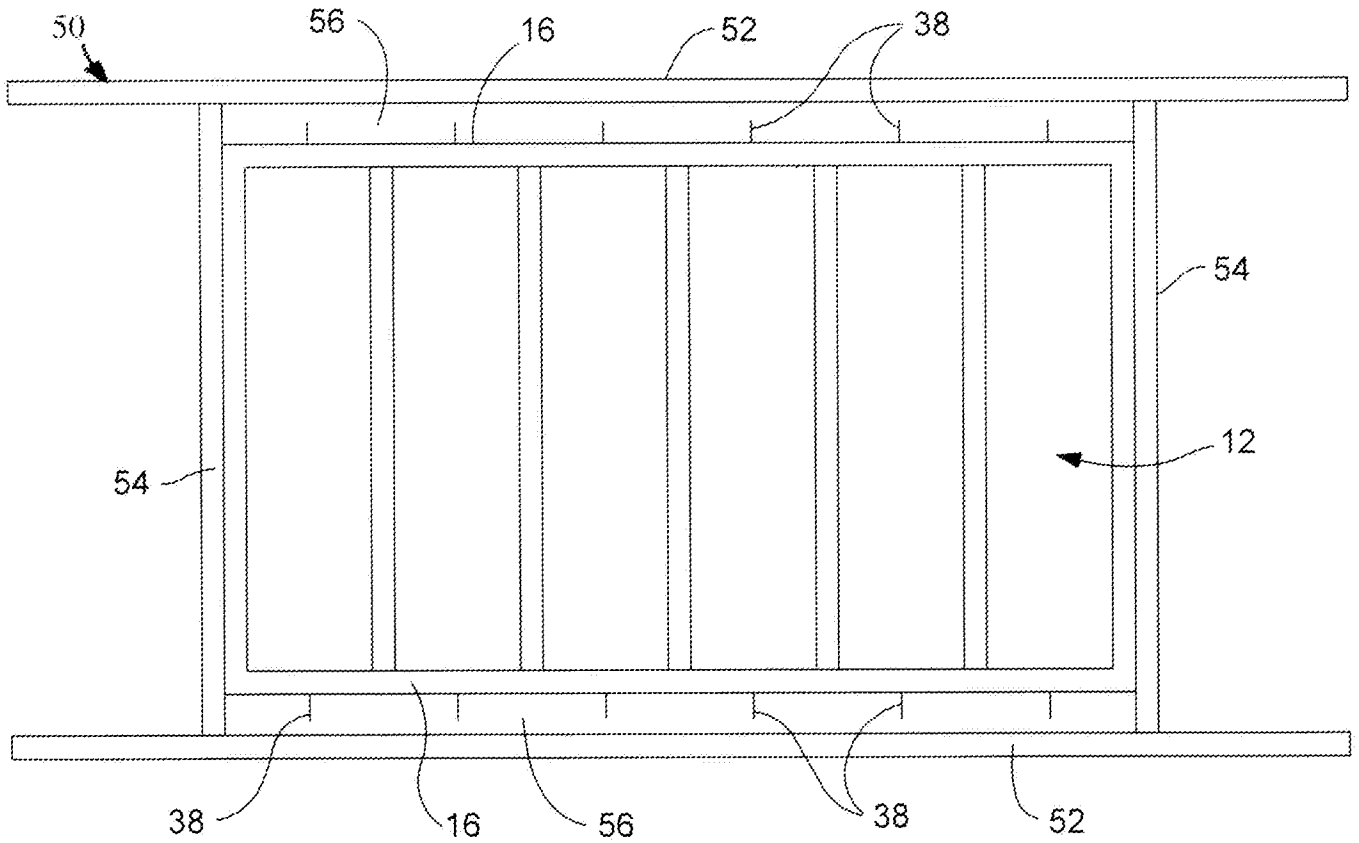
FIG. 2 is a top view of a casting bed and casting frame for forming concrete wall structures in accordance with an embodiment of the disclosed subject matter.

An embodiment of forming the concrete wall structure 10 is illustrated in FIGS. 2 through 5. As illustrated in FIG. 2, a casting bed 50 is provided. The casting bed includes a first pair opposing panels 52 that are interconnected by a second pair of opposing panels 54. At least one panel of either pair of opposing panels 52, 54 may be moveable to define an interior volume of the casting bed 50. A bracket (not illustrated) may be provided in engagement with at least one of the panels 52, 54 for imparting movement thereto. This bracket may be secured to a nearby structure by any suitable method to define the interior volume of the casting bed 50. In one embodiment, the bracket may be secured to the nearby structure by a C-clamp.

The frame 12 is placed within the casting bed 50. In an embodiment, a gap 56 may be provided between at least one exterior surface of the frame 12 and the casting bed 50. The frame 12 may also include a plurality of fasteners 38 extending from opposing frame members 12 in order to provide additional structural integrity to the concrete wall structure 10.

Figure 3:
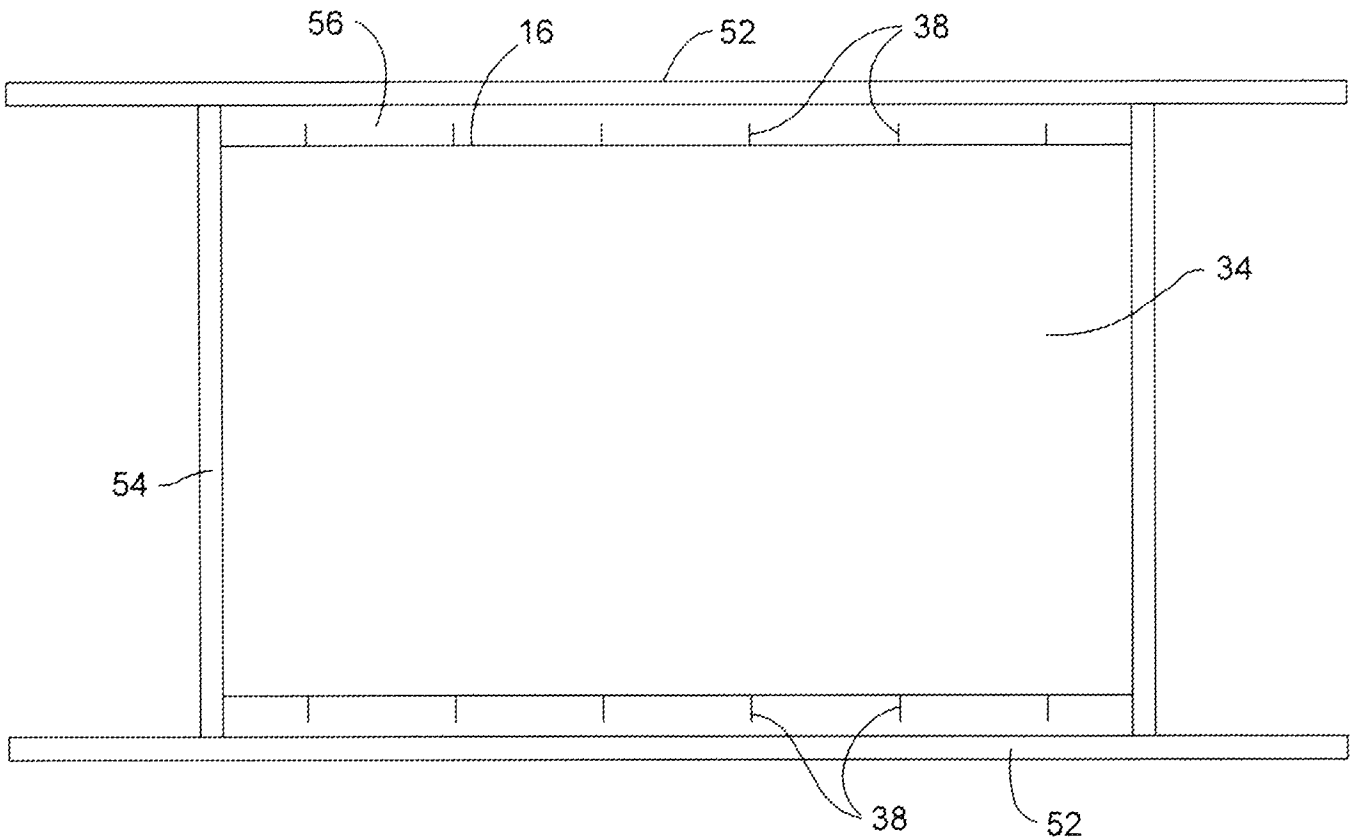
FIG. 3 is a top view of a casting bed and a casting frame with an insulating layer being carried thereon for forming concrete wall structures in accordance with an embodiment of the disclosed subject matter.

With reference to FIG. 3, the sheet of insulating material 34 may then be positioned on the frame 12. This sheet of insulating material 34 may be sized such that substantially all of the frame 12 is covered, or in an alternate embodiment, the sheet of insulating material 34 may cover more or less of the frame 12. The sheet of insulating material 34 may be fastened to or simply rest upon frame 12. For example, the sheet of insulating material 34 may be fastened to the frame 12 by the use of mechanical fasteners such as screws or bolts, or may be fastened to the frame 12 by the use of chemical fasteners such as an adhesive. A plurality of support members (not illustrated) may be provided below the sheet of insulating material 34 so as to provide support thereto during assembly. These support members may be bricks, concrete blocks, or any other suitable object.

Figure 4:
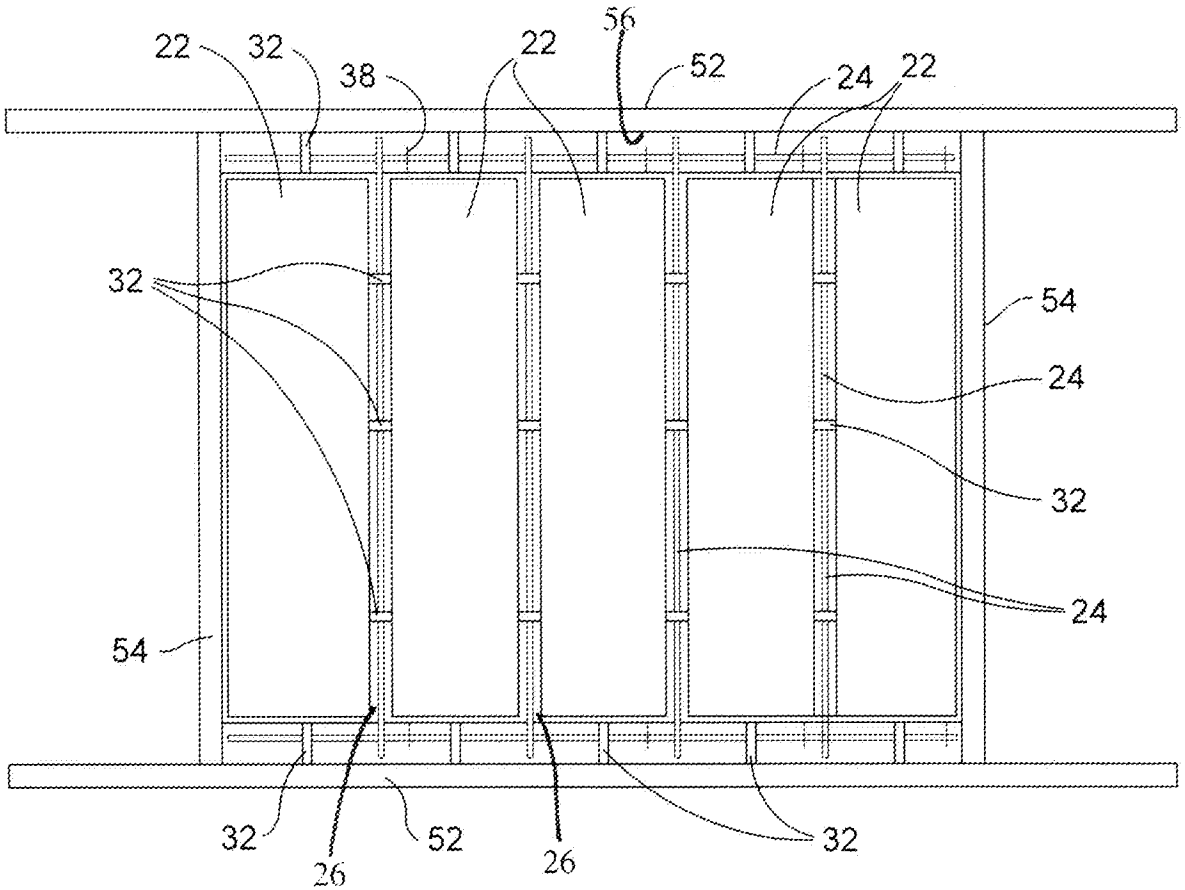
FIG. 4 is a top view of a casting bed, casting frame with an insulating layer being carried thereon, and a plurality of blocks with reinforcing beams positioned therebetween for forming concrete wall structures in accordance with an embodiment of the disclosed subject matter.

With reference to FIG. 4, a plurality of blocks 22 are positioned on the sheet of insulating material 34. In one embodiment, each of the plurality of blocks 22 may be constructed of an insulating foam. The plurality of blocks 22 may be spaced-apart from each consecutively spaced block so as to form a void 26 therebetween. The void 26 is sized so as to receive a support beam 24. Support beam 24 may be a rebar or any other suitable type of reinforcing material and is provided for increased structural integrity of the concrete wall structure 10. A spacer 32 may be carried by the support beam 24 and is configured so as to define the dimensions of the void 26 between consecutively placed blocks of the plurality of blocks 22. Additional support beams 24 may also be provided in the gap 56 defined between the frame 12 and casting bed 50.

Figure 5:
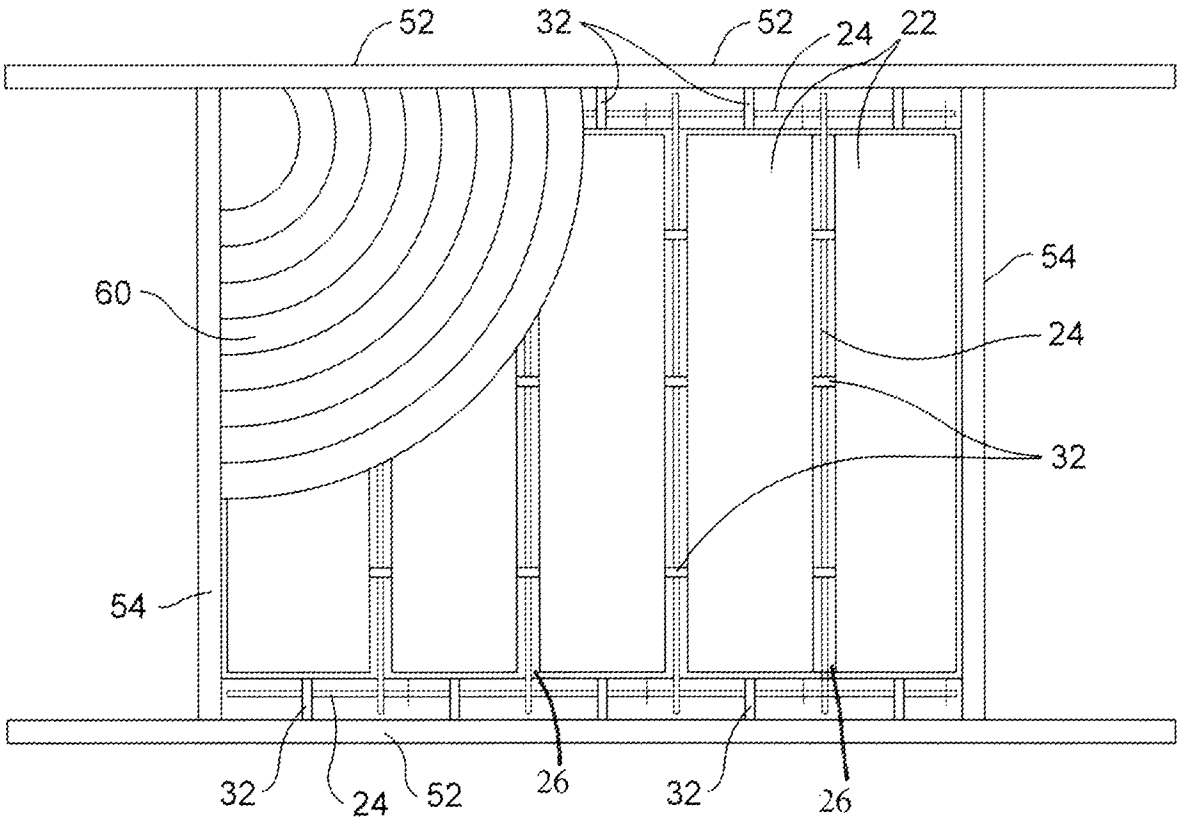
FIG. 5 is a top view of a casting bed, casting frame, and plurality of blocks as illustrated in FIG. 4 and having a layer of concrete poured into the casting bed in accordance with an embodiment of the disclosed subject matter.

With reference to FIG. 5, concrete 60 is then poured into the casting bed 50. Concrete 60 flows into the voids 26 formed between consecutively spaced blocks 22 and into the gap 56 defined between the frame 12 and the casting bed 50 to thereby form the header and footer sections 36 as illustrated in FIG. 1. The concrete 60 is then finished according to concrete finishing methods known in the art including leveling and floating. In an alternate embodiment, two or more layers of a plurality of blocks may be used with a concrete layer optionally formed between the two or more layers to provide a concrete wall structure having even greater insulating and weight-reducing characteristics.

The concrete support wall 10 is then removed from the casting bed 50 by removing the panels 52 and 54 until the casting bed 50 is no longer in engagement therewith. The wall 10 may then be rotated into an upright position and any additional finishing of the wall 10 may then be completed.

Figure 6:
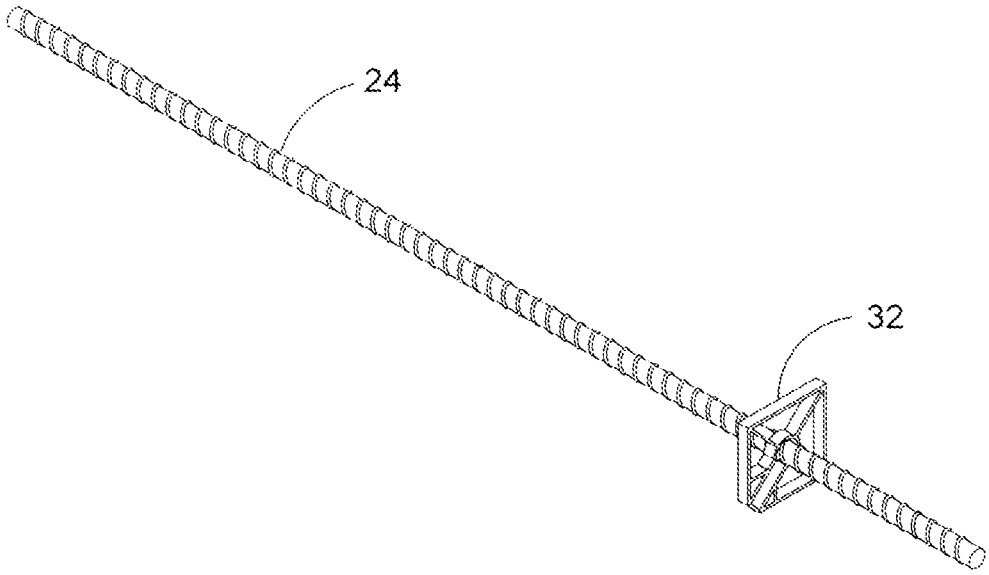
FIG. 6 is a perspective view of a reinforcing beam and a spacer carried thereon in accordance with an embodiment of the disclosed subject matter.

The support beam 24 and spacer 32 are illustrated in FIG. 6. As shown in FIG. 6, the spacer 32 may be a generally square shaped spacer having a slot defined therein for receiving the support beam. In another embodiment, an alternately shaped spacer 32 may be provided such as a circular spacer. The dimensions of spacer 32 may be altered by providing spacers of varying dimensions so that variously sized voids 26 may be provided between consecutively spaced blocks 22.

Concrete wall structures as described herein can be assembled at a manufacturing plant and subsequently delivered to a construction site. Next, the concrete wall structures can be connected together at the construction site to form a complete wall structure of a building.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A method for forming a concrete wall structure, the method comprising:

positioning a frame having a plurality of spaced-apart wall studs interconnecting opposing frame members within a casting bed;

positioning a plurality of blocks proximal the frame at predetermined positions within an interior area of the casting bed;

pouring concrete within the casting bed;

finishing concrete within the casting bed; and wherein a support panel is provided between the frame and the plurality of blocks, wherein the support panel is formed from an insulating material.

2. The method of claim 1 wherein the support panel spans about a width of the frame.

3. The method of claim 1 comprising providing a support member positioned between respective wall studs for providing support to the support panel while pouring concrete within the frame.

4. The method of claim 1 wherein each of the plurality of blocks are spaced-apart so as to form a void between consecutively spaced blocks, and further comprising a support beam positioned within at least one of the voids.

5. The method of claim 4 comprising providing a spacer carried by the support beam to define at least one dimension of the void between consecutively spaced blocks.

6. The method of claim 1 wherein the plurality of blocks are formed from an insulating foam material.

7. A method for forming a concrete wall structure comprising:

providing a casting bed having a plurality of surfaces that define an interior, at least one of the plurality of surfaces being moveable to define a predetermine dimension of the casting bed;

placing a casting frame having a plurality of spaced-apart wall studs interconnecting opposing frame members in the casting bed;

providing a support panel onto the frame, the support panel having a plurality of foam insulating blocks thereon that are spaced-apart by a support beam placed therebetween;

pouring concrete that extends into the spaces between spaced-apart blocks and forms a concrete layer; and wherein the support panel is formed from an insulating material.

8. The method of claim 7 wherein the support panel spans about a width of the frame.

9. The method of claim 7 comprising providing a support member positioned between respective wall studs for providing support to the support panel while pouring concrete within the frame.

10. The method of claim 7 comprising providing a spacer carried by the support beam to define at least one dimension of the space between consecutively spaced blocks.

* * * * *